US005472112A

United States Patent [19]

Maciejewski

[11] Patent Number: 5,472,112

[45] Date of Patent: Dec. 5, 1995

[54] QUICK-POUR CONTAINER

[75] Inventor: Wendell C. Maciejewski, Salem, Conn.

[73] Assignee: The United States of America as represented by the Secretary of the Navy, Washington, D.C.

[21] Appl. No.: 332,172

[22] Filed: Oct. 31, 1994

[51] Int. Cl.[6] ..... B65D 90/32

[52] U.S. Cl. ..... 220/745; 141/309; 141/327; 220/89.2; 222/545; 222/541.6

[58] Field of Search ..... 220/745, 89.2, 220/DIG. 27, 277; 141/285, 309, 325–327; 222/80–83, 89, 90, 541, 545, 478, 481; 215/11.4, 2; 137/68.1

[56] References Cited

U.S. PATENT DOCUMENTS

| | | | |
|---|---|---|---|
| 1,147,629 | 7/1915 | Hatvany | 215/2 |
| 1,694,754 | 12/1928 | Porter | 215/11.4 X |
| 2,543,163 | 2/1951 | Greiner | 222/481 |
| 3,204,835 | 9/1965 | Michel | 222/541 |
| 4,385,714 | 5/1983 | Szabo et al. | 222/80 |
| 4,394,926 | 7/1983 | Ou et al. | 137/68.1 |
| 4,762,241 | 8/1988 | Lang | 215/306 X |

*Primary Examiner*—Allan N. Shoap
*Assistant Examiner*—Robin A. Hylton
*Attorney, Agent, or Firm*—Michael J. McGowan; Michael F. Oglo; Prithvi C. Lall

[57] ABSTRACT

A quick-pour container of the present invention includes a base portion, a body portion extending upwardly from the base portion, and a spout portion integrally formed with the body portion. The spout portion has a mouth through which fluid contained in the container flows when emptying it. An upwardly extending neck portion is formed in the base portion, the neck portion defining a downwardly opening cavity. An annular wall of the neck portion terminates at its upper end to define an opening which is closed by a membrane attached to the neck portion to contain fluid in the container. A puncturing device controls and quickens the flow of fluid from the container when emptying it. The puncturing device has a member movable by manual manipulation between a fluid stored position in which it is spaced from the membrane to a puncturing position in which the member moves through the opening to puncture the membrane for allowing gas to be vented into the container when emptying the fluid from the container thereby controlling and quickening the flow of fluid therefrom.

14 Claims, 3 Drawing Sheets

QUICK-POUR CONTAINER

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

This invention relates generally to containers, and more particularly to a quick-pour container suitable for dispensing engine fluids, such as motor oil and transmission fluid.

(2) Description of the Prior Art

A problem associated with a typical plastic container or bottle which contains fluid, such as motor oil or transmission fluid, is that the fluid pours out of the bottle poorly since there is no vent at the bottom of the bottle to vent air into the bottle. Thus, the liquid contained in the bottle flows slowly and unevenly (in spurts) out of the bottle. One solution has been to puncture the bottom wall of the bottle with a sharp implement, such as a knife, screwdriver, or awl while pouring out the contents of the bottle. Once punctured, the interior of the bottle is vented to atmosphere thereby quickening and controlling the flow of fluid out of the bottle.

A disadvantage of this solution is that it is sometimes awkward to puncture the bottom wall of the bottle while simultaneously dispensing the fluid. There is a risk that the person performing such an operation may unwantingly spill the oil. Also, this operation can be particularly dangerous, especially when a very sharp implement is used. Another disadvantage is that after the bottle is emptied and set down on a surface, residual fluid adhered to the inside surfaces of the bottle flows downwardly and settles in the bottom of the bottle. Since the opening is typically formed in the bottom wall, the fluid flows through the opening and onto the surface.

SUMMARY OF THE INVENTION

The instant invention provides an improved quick-pour container.

Accordingly, among the several objects of the present invention are the provision of an improved quick-pour container which dispenses fluid quickly and evenly; the provision of such a container which requires no implements to puncture the container for venting air therefrom; the provision of such a container which is relatively safe to use; the provision of such a container having a trap formed in the bottom of the container for trapping residual fluid therein after dispensing fluid from the container thereby avoiding the risk of fluid flowing through the opening in the bottom of the container when the container is placed on a flat surface; and the provision of such a container which is simple in design and easy to use.

In general, a quick-pour container of the present invention comprises a base portion adapted to lie on a flat surface, a body portion extending upwardly from the base portion, and a first opening integrally formed in the body portion adjacent its upper end. The opening provides a mouth through which fluid in the container flows when emptying the container. An upwardly extending neck portion having an annular wall is formed in the base portion. The neck portion defines a downwardly opening cavity and the annular wall of the neck portion terminates at its upper end to define a second opening in the container. A membrane is attached to the neck portion for normally blocking the opening to seal the container against outflow of fluid.

A membrane perforation device is mounted within the cavity and accessible when tipping the container when emptying it. The device includes a rectilinearly movable elongated member having an upper end adapted to perforate the membrane and disposed within and longitudinally aligned with the downwardly opening cavity. The elongated member is movable between a fluid storage position in which the upper end of the elongated member is spaced from the membrane to an operative position in which the upper end engages the membrane to break it open. Thus, ambient gaseous medium is allowed to enter into the container to smooth and quicken the flow of fluid during emptying of the container through the first opening.

Other objects, features and advantages of the invention shall become apparent as the description thereof proceeds when considered in connection with the accompanying illustrative drawings.

BRIEF DESCRIPTION OF THE DRAWINGS

A more complete understanding of the invention and many of the attendant advantages thereto will be readily appreciated as the same become better understood by reference to the following detailed description when considered in conjunction with the accompanying drawings wherein.

Corresponding reference numerals designate corresponding parts throughout the several views of the drawings.

DETAILED DESCRIPTION OF THE PREFERRED EMBODIMENT

Figure 1:
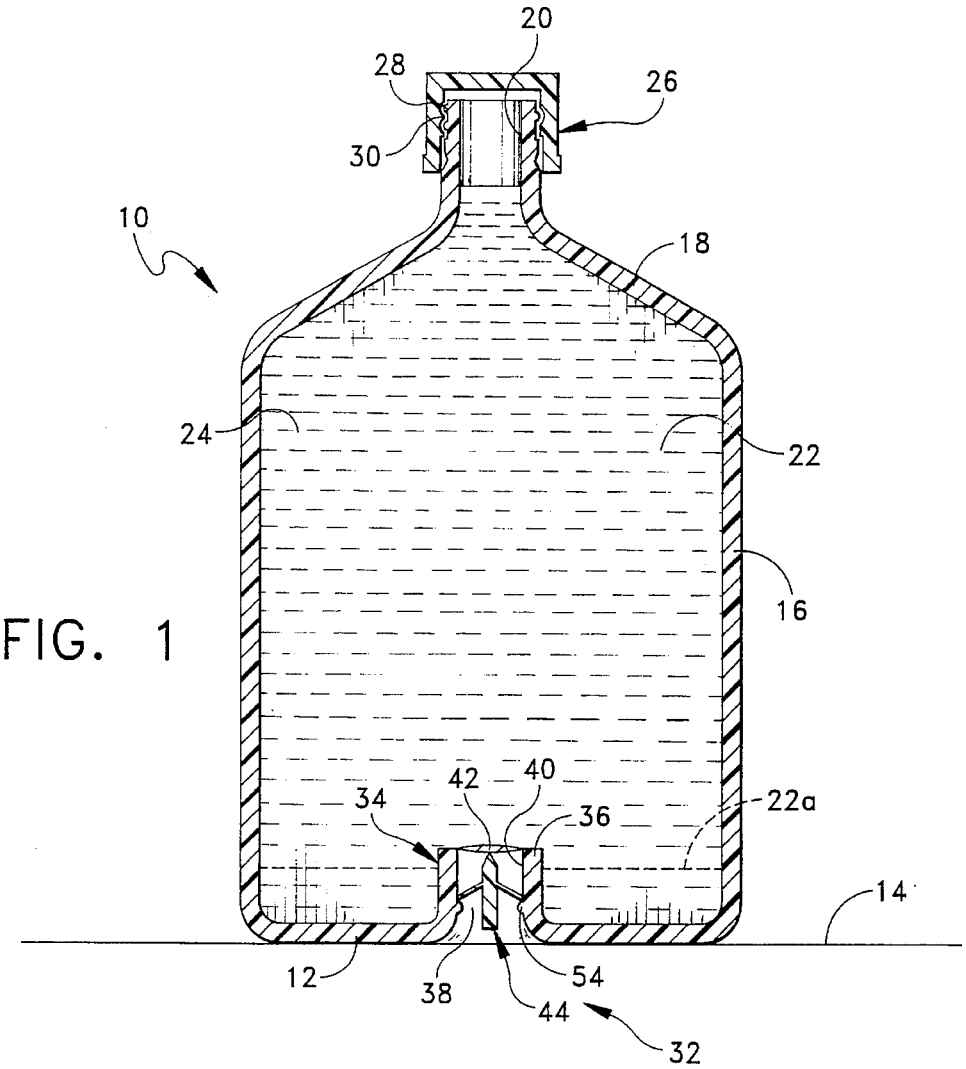
FIG. 1 is a cross section elevational view of a quick-pour container of the present invention.
Figure 2:
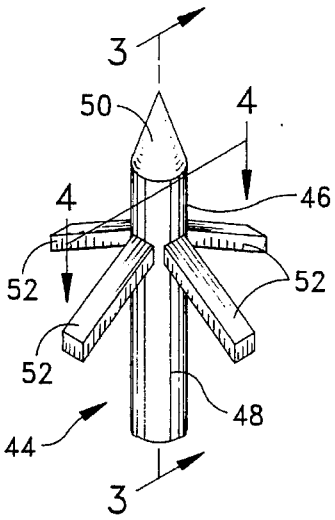
FIG. 2 is a front perspective view of a puncturing device of the quick-pour container.
Figure 3:
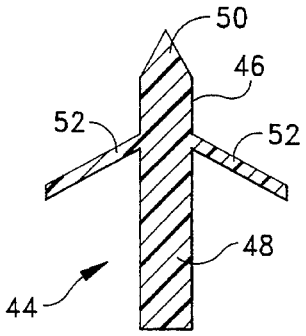
FIG. 3 is a cross-sectional view taken along line 3—3 of FIG. 2.
Figure 4:
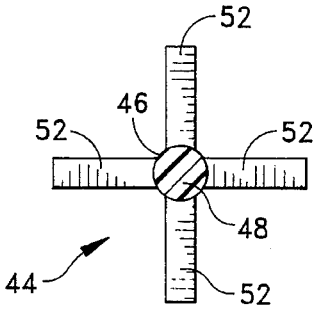
FIG. 4 is a cross-sectional view taken along line 4—4 of FIG. 2.

Referring now to the drawings, and more particularly to FIG. 1, there is generally indicated at 10 a quick-pour container of the present invention. The quick-pour container 10 is of the type used to contain fluids, such as motor oil, transmission fluid, brake fluid or any other similar fluid which is typically dispensed after the container is opened.

As illustrated, the quick-pour container 10 comprises a base portion 12 which is adapted to lie on a flat surface 14, such as a table top, a body portion 16 which extends upwardly from the base portion 12 and is integral therewith, and a spout portion 18 which is integrally formed with the body portion 16. The spout portion 18 includes a mouth 20 (otherwise sometimes referred to as the "first opening")

through which fluid 22 contained in the container 10 flows when emptying the container. As shown, the mouth 20 is relatively small so that the fluid 22 may be poured into a relatively small opening. The base, body and spout portions 12, 16 and 18 combine to define an interior region 24 in which fluid 22 is contained. Preferably the quick-pour container 10 is fabricated from plastic and manufactured by a molding process. The container 10 could also be fabricated from other materials, such as aluminum or cardboard, and still fall within the scope of the present invention.

A cap, generally indicated at 26, is releasably attachable to the spout portion 18 for blocking the mouth 20 to normally maintain fluid 22 within the container 10 and for preventing the unintended exit of fluid through the mouth 20. As illustrated in FIG. 1, the spout portion 18 of the container 10 is formed with threads 28 on its outer surface for threadably engaging internal threads 30 of the cap. A thin foil seal (not shown) attachable to the spout portion 18 around the mouth 20 may also be provided for ensuring fluid does not inadvertently exit the container 10 through the mouth 20. The cap 26 is also preferably made from plastic.

It should be noted that the container 10 described to this point is much like containers or bottles of conventional design. During use, the cap 26 and seal (if provided) are removed from the spout portion 18 so that the fluid 22 in the container 10 (e.g., motor oil) may be poured (e.g., into an engine). Fluid 22 contained in containers of conventional design does not pour quickly and evenly, but tends to "gurgle" slowly out of the container since the air trapped in the container must be vented from the bottom of the container through the container's mouth along with the fluid being dispensed.

The container 10 of the present invention includes means, generally indicated at 32, for controlling and quickening the flow of fluid 22 from the container 10 when emptying it. Means 32 comprises an upwardly extending neck portion generally indicated at 34, formed in the base portion 12. As illustrated, the neck portion 34 includes an annular wall 36, integral with the base portion 12, which extends upwardly into the interior region 24. The neck portion 34 defines a downwardly opening cavity 38 which comprises part of the exterior surface of the base portion 12 of the container 10. The annular wall 36 of the neck portion 34 terminates at its upper end to define an opening 40 (otherwise sometimes referred to as the "second opening") which provides communication between the interior region 24 of the container 10 and atmosphere. The opening 40 is of circular configuration and is covered to prevent liquid from flowing out of the container therethrough by a frangible membrane 42 attached to the neck portion for blocking the opening 40 to contain the fluid 22 within the bottle 10.

Figure 5:
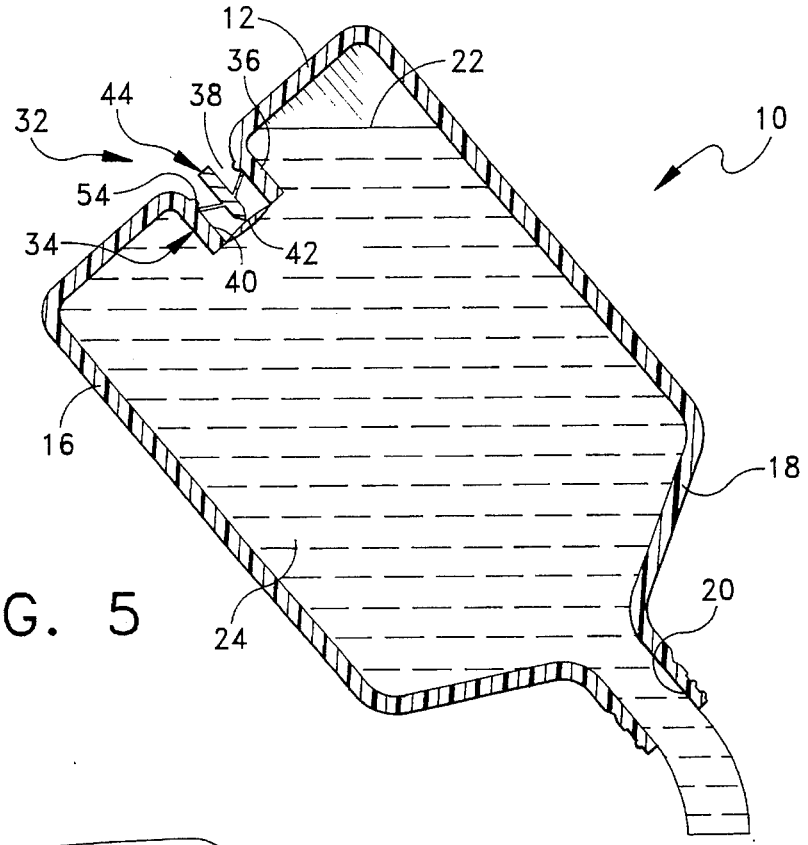
FIG. 5 is a cross section elevational view of the quick-pour container illustrating fluid being emptied from the container.
Figure 6:
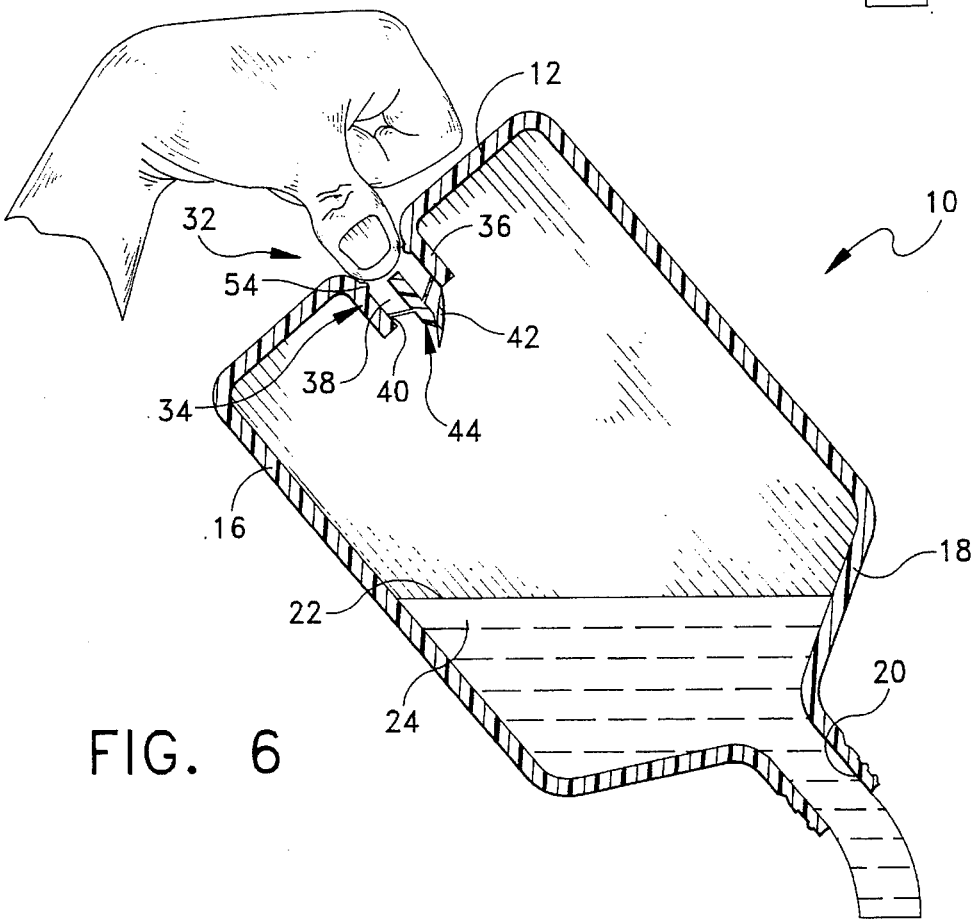
FIG. 6 is a cross section elevation view similar to FIG. 5 but showing the puncturing device puncturing a membrane for venting gas from the container.
Figure 8:
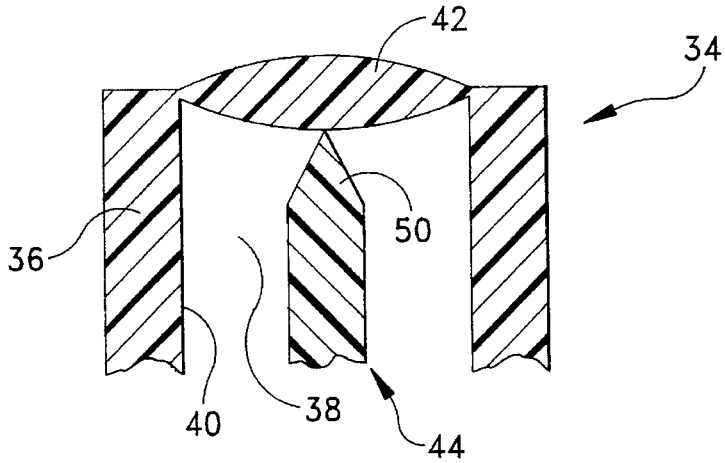
FIG. 8 is an enlarged cross-sectional view of the membrane and puncturing device illustrated in FIGS. 1, 5, and 6.

As illustrated in FIGS. 1,5 and 6, the membrane 42 is relatively thin compared to the thickness of the base, body and spout portions 12, 16 and 18. More specifically, the membrane 42 is in the form of a circular disk made from rupturable material having weakened loci along which the membrane will rupture in response to being exerted by a force thereon. As shown in FIG. 8, the membrane 42 is attached along its peripheral edge to the upper end of the annular wall 36 of the neck portion 34. The membrane 42 decreases in thickness in radial direction from its center, whereby the weakened loci substantially coincides with its peripheral edge. Preferably, the membrane 42 is integral with the annular wall 36 of the neck portion 34; however, the membrane 42 could also comprise a thin sheet of foil fixedly attached to the annular wall 36 of the neck portion 34. In either configuration, the membrane 42 is designed to be strong enough to prevent the fluid 22 contained in the container 10 from breaking the membrane 42 when fluid pressure within the container increases, yet weak enough to be punctured upon being engaged by an appropriate implement.

Means 32 further comprises a membrane perforating or puncturing device, generally indicated at 44, provided within the cavity 38 and accessible when tipping the container 10 to empty it, for puncturing the membrane 42 to vent the container 10 when pouring its contents. The puncturing device 44 comprises a rectilinearly movable elongated member 46 having a cylindrical body 48 terminating in a sharp tip 50 at its upper end and a plurality of flexible fingers, each indicated at 52, extending radially from the body 48 of the member 46 in an equiangular spaced relation. As illustrated, the member 46 is disposed within and longitudinally aligned with the cavity 38 and has a cross-sectional area significantly less than the transverse cross-sectional area of the downwardly opening cavity. Although FIGS. 1–7 illustrate a body having a circular cross section, it is to be understood that the body 48 may have any cross section. The member 46 is movable by manual manipulation between a fluid storage position in which it is spaced from the membrane 42 (FIG. 5) to an operative or puncturing position in which the member 46 moves through the opening 40 of the neck portion 34 to puncture the frangible membrane 42 (FIG. 6). Upon puncturing the membrane 42, ambient gaseous medium (e.g., air) is allowed to enter the container 10 so that when emptying the container, the flow of fluid 22 from the container 10 is controlled and quickened in a well-known manner.

As illustrated, there are four flexible fingers 52 which engage the annular wall 36 of the neck portion 34 for releasably securing the puncturing device 44 to the container 10. The fingers 52 maintain the member 46 in its stored position and prevent the unwanted removal of the member 46 out of the cavity 38 of the neck portion 34 while allowing the movement of the member 46 to its membrane puncturing position. More specifically, the member 46 is centrally disposed in the cavity 38 with a lateral space between the member 46 and the inner surface of the wall 36. The fingers 52 extend through the space and engage the inner surface of the annular wall 36 for maintaining the device 44 in an assembled relationship with the container 10 (i.e., in its stored position), but nevertheless in a relationship allowing movement of the member 46 to its operative position. The annular wall 36 has an inwardly extending detent or rib 54 formed on its inner (lateral) surface which extends into the cavity 38 for engaging the terminal ends of the fingers 52 to prevent the removal of the member 46 from the cavity 38 while allowing the movement of the member 46 through the opening 40. The rib 54 functions as an annular collar for keeping the device 44 in the cavity 38.

Figure 7:
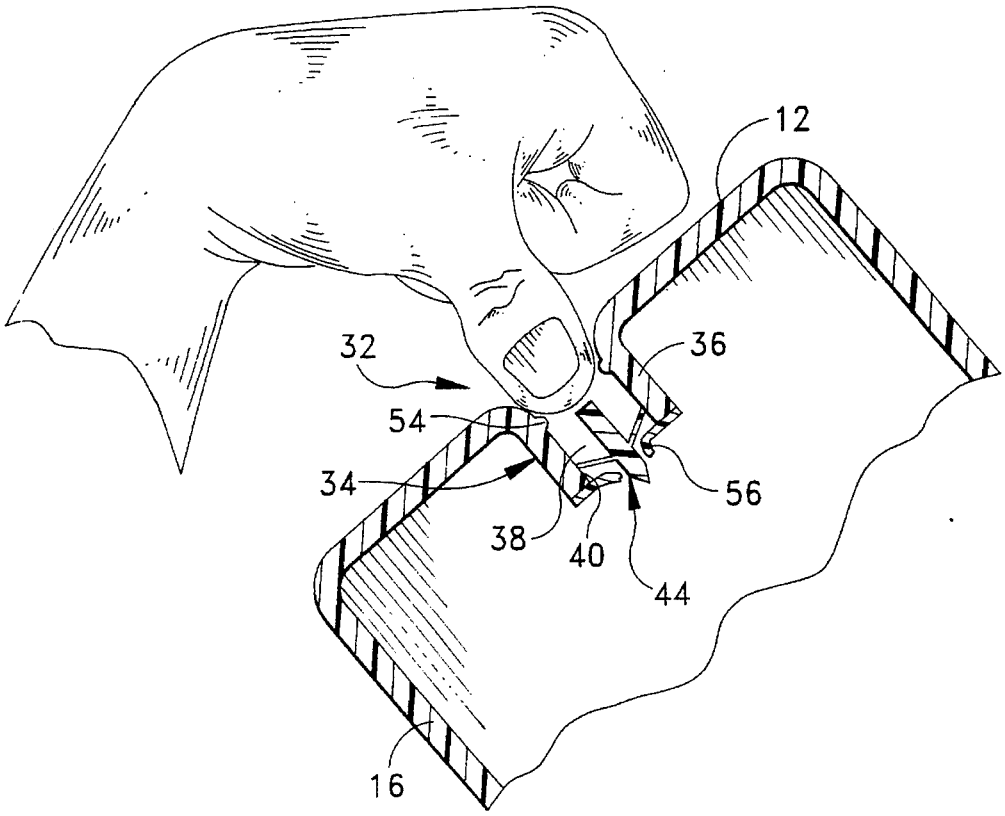
FIG. 7 is a view illustrating a container having a modified form of membrane.

As illustrated in FIG. 6, the membrane 42 breaks away from the annular wall 36 of the neck portion 34 around its outer periphery when being punctured by the member 46. FIG. 7 illustrates a membrane 56 of an alternate embodiment having a uniform thickness. When membrane 56 is engaged by the puncturing device 44, the sharp tip 50 of the member 46 breaks through the membrane 56 for allowing air to vent into the container 10 through the opening 40.

The annular wall 36 of the neck portion 34 is of sufficient length so as to extend above the level of any residual fluid **22*a* (FIG. 1) that will normally remain in the container after pouring out the contents thereof. Thus, the residual fluid is prevented from flowing out the opening 40 and through the displaced or punctured membrane, which if permitted, might damage or soil the surface 14 on which the container is positioned. Residual fluid will normally be present after the container has been emptied because the viscosity of the fluid, particularly where oil or the like is the fluid, results in a residue of fluid on the inner surface of the container, which gravitates to the bottom of the container. It has been discovered that the annular wall 36 does not have to be extremely long, just long enough to contain the residual fluid 22 in the container 10** (e.g., approximately one-quarter inch).

Moreover, the member 46 is shorter than the length of the annular wall 36 of the neck portion 34 so that the member 46 is completely contained within the cavity 38. Thus, the container 10 is capable of resting upon the surface 14 without interference from the member 46.

FIGS. 5 and 6 illustrate the container 10 of the present invention during use. As shown, when pouring fluid 22 contained in the container 10, the puncturing device 44 is easily accessible for displacing or puncturing the membrane 42 to vent gas trapped in the container 10 to atmosphere. This may be accomplished with one hand and without the aid of sharp implements. As illustrated, the member 46 is moved through the opening 40 for displacing or puncturing the membrane 42 thereby providing communication between the interior region 24 of the container 10 and atmosphere. After the contents are emptied from the container 10, it may be placed on the horizontal surface 14. The upwardly extending neck portion 34 prevents any residual fluid contained in the container 10 from flowing downwardly through the opening 40 and onto the surface 14.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A quick-pour container for containing fluid comprising:

a base portion adapted to lie on a flat surface;

a body portion extending upwardly from the base portion;

a first opening integrally formed in the body portion adjacent its upper end, said opening providing a mouth through which fluid in the container flows when emptying same;

an upwardly extending neck portion having an annular wall formed in the base portion, said neck portion defining a downwardly opening cavity, said annular wall of said neck portion terminating at its upper end to define a second opening in the container;

a membrane attached to said neck portion for blocking said second opening to seal the same against outflow of fluid; and a membrane perforation device provided within said cavity and accessible when tipping the container to empty same, said device including a rectilinearly movable elongated member having an upper end adapted to perforate the membrane and disposed within and longitudinally aligned with said downwardly opening cavity, said elongated member being movable between a fluid storage position in which said upper end of the elongated member is spaced from the membrane to an operative position in which said upper end engages the membrane to break the same open, thus allowing ambient gaseous medium to enter into the container, to thereby smooth and quicken flow of fluid during emptying of the container through the first opening.

2. The quick-pour container as set forth in claim 1 said rectilinearly movable elongated member being cylindrical and terminating in a sharp tip at its upper end.

3. The quick-pour container as set forth in claim 2 said membrane being made from a rupturable material having weakened loci along which it will rupture in response to the exertion of force thereagainst by said upper end of the rectilinearly movable elongated member.

4. The quick-pour container as set forth in claim 3 said membrane being a circular disk which is attached along its peripheral edge to the upper end of said annular neck portion and which decreases in thickness in radial direction from its center, whereby said weakened loci substantially coincides with its peripheral edge.

5. The quick-pour container as set forth in claim 2 said membrane comprising a sheet of foil fixedly attached to the annular wall of the neck portion and adapted to puncture in response to the sharp tip of the rectilinearly movable elongated member being urged there against.

6. The quick-pour container as set forth in claim 1 wherein:

said rectilinearly movable elongated member is disposed in said downwardly opening cavity with a lateral space between the elongated member and the inner surface of the annular wall of said downwardly extending cavity; and said membrane perforation device is further comprised of at least one flexible finger attached to the elongated member and extending through said space and engaging the inner surface of the annular wall for maintaining the membrane perforating device in an assembled relationship with the container within the cavity, but nevertheless in a relationship allowing movement of the elongated member to its membrane engaging position.

7. The quick-pour container as set forth in claim 6 said annular wall having an inwardly extending detent formed on its lateral surface for engaging said at least one finger to inhibit the removal of the rectilinearly movable elongated member from the cavity.

8. The quick-pour container as set forth in claim 7 wherein:

said rectilinearly movable elongated member is of cross-sectional significantly less than the transverse cross-sectional area of the downwardly opening cavity and is centrally disposed therein;

said number of fingers being at least three, and the fingers being disposed in equiangular spaced relation about the axis of the elongated member; and said inwardly extending detent is an annular collar formed on the annular wall of said downwardly opening cavity.

9. The quick-pour container as set forth in claim 6 the length of the rectilinearly movable elongated member being shorter than the length of the annular wall of the neck portion so that the elongated member is completely contained within the cavity.

10. The quick-pour container as set forth in claim 1 said membrane being integral with said annular wall of the neck portion.

11. The quick-pour container as set forth in claim 1 said annular wall of the neck portion being of sufficient length to extend above the level of residual fluid normally remaining in the container after the emptying thereof.

12. The quick-pour container as set forth in claim 1 said annular wall of the neck portion being integrally formed with the base portion.

13. The quick-pour container as set forth in claim 1 said container being fabricated from molded plastic.

14. The quick-pour container as set forth in claim 1 which further comprises a closure cap removably blocking said first opening to prevent unintended exit of fluid therethrough.

* * * * *